United States Patent [19]

Morrison

[11] Patent Number: 4,848,959

[45] Date of Patent: Jul. 18, 1989

[54] RETAINING CLIP AND BLADE MOUNTING APPARATUS

[76] Inventor: Donald R. Morrison, 6228 Eagle Peak Dr., Charlotte, N.C. 28214

[21] Appl. No.: 198,978

[22] Filed: May 26, 1988

Related U.S. Application Data

[63] Continuation-in-part of Ser. No. 151,456, Feb. 2, 1988.

[51] Int. Cl.[4] ..... E01C 19/22

[52] U.S. Cl. ..... 404/112; 404/118

[58] Field of Search ..... 404/112; 15/235.4; 51/177

[56] References Cited

U.S. PATENT DOCUMENTS

| | | | |
|---|---|---|---|
| 1,005,208 | 10/1911 | Heltzel | 15/235.4 |
| 2,556,983 | 6/1951 | Root | 404/112 |
| 2,662,454 | 12/1953 | Whiteman | 404/112 |
| 2,865,269 | 12/1958 | McMillan | 404/112 |
| 3,375,766 | 4/1968 | Zochil | 404/112 |
| 3,683,761 | 8/1972 | Babic | 404/112 |

*Primary Examiner*—Jerome W. Massie, IV
*Assistant Examiner*—Matthew Smith
*Attorney, Agent, or Firm*—Olive & Olive

[57] ABSTRACT

The present mounting apparatus includes a pair of retaining tabs secured to an upper surface of a blade adjacent leading corners. Each retaining tab includes a side wall, and end wall and a cover plate which forms a cavity with the blade upper surface. A pair of retaining tabs are secured to the upper surface of the blade adjacent trailing corners. The four retaining tabs cooperate to removably secure the blade to a trowel finishing blade without the use of mechanical fasteners. Spring-type retaining clips can be utilized with the tabs to further secure the blade to a trowel finishing blade.

9 Claims, 6 Drawing Sheets

RETAINING CLIP AND BLADE MOUNTING APPARATUS

CROSS REFERENCE TO RELATED APPLICATIONS

This is a continuation-in-part of copending application Ser. No. 07/151,456 filed Feb. 2, 1988.

BACKGROUND OF THE INVENTION

1. Field of the Invention

The present invention relates generally to a retaining, clip and a mounting apparatus for removable attachment of a float blade or a combination blade to a blade assembly of a trowel.

2. Description of the Related Art

Generally, motor-powered trowels include a rotary blade assembly which engages, packs and finishes concrete, cement and the like. The blade assembly may include float blades or combination blades removably secured to each finishing blade of the blade assembly.

In conventional practice, newly poured concrete or cement is first worked with float blades, to smooth the concrete surface and achieve a uniform appearance. Simultaneously, the floating operation settles large stones and causes fine particles to rise to the surface. Thereafter, the float blades are removed from the blade assembly. The concrete then is finished with finishing blades which are standard equipment on most trowels. Conventional float blades are constructed from abrasion-resistant steel. The use of removable float blades increases the life of the finishing blade assembly. Reversible float blades are known but have not come into widespread usage.

Alternatively, a combination blade can be removably attached to the trowel blade assembly. The combination blade is utilized for both the floating and finishing operations.

Various systems have been devised to quickly mount a float blade or a combination blade on a trowel blade assembly. Prior art methods are described in the following representative U.S. Pat. Nos. 2,556,983; 2,662,454; 2,689,507; 2,865,269; 2,888,863; 2,999,261 and 3,375,766.

The art continues to seek improvements. It is desirable that a float blade or a combination blade be readily and removably mountable on a trowel finishing blade. It is desirable that a mounting system be economical to install, easy to operate and adaptable for either float or combination blades.

SUMMARY OF THE INVENTION

The present invention relates to a blade construction and to an apparatus for removably mounting a blade on a finishing blade of a trowel. The mounting apparatus is economical to install, easy to operate and adaptable for either a float blade or a combination blade. The blade construction of the invention further relates to float blades and combination blades employing the present mounting apparatus.

In a preferred embodiment, the present mounting apparatus includes a pair of retaining tabs secured to an upper surface of a blade adjacent leading corners. Each retaining tab includes a side wall, an end wall and a cover plate which forms a cavity with the blade upper surface. A pair of retaining tabs are secured to the upper surface of the blade adjacent trailing corners. The four retaining tabs cooperate to removably secure the blade to a trowel finishing blade without the use of mechanical fasteners. Spring-type retaining clips can be utilized with the tabs to further secure the blade to a trowel finishing blade. In an alternative embodiment, at least one stop element replaces the trailing retaining tabs to secure a blade on a trowel finishing blade.

DETAILED DESCRIPTION OF THE PREFERRED EMBODIMENTS

Figure 1:
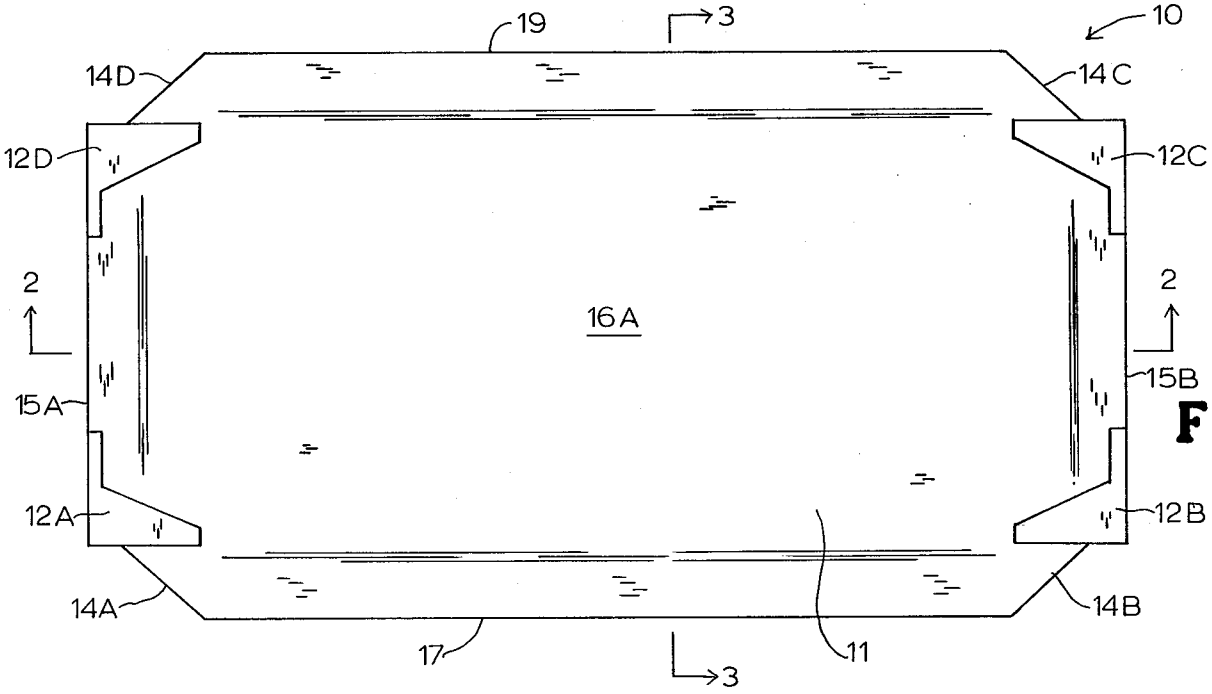
FIG. 1 is a top plan view of a float blade employing the present mounting apparatus.
Figure 3:
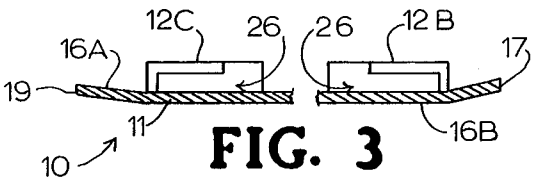
FIG. 3 is a sectional view taken along line 3—3 of FIG. 1.
Figure 2:
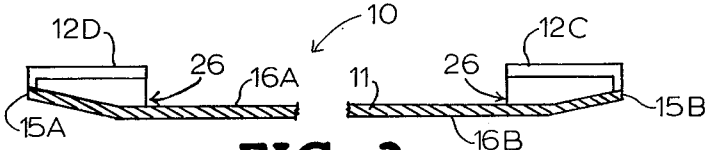
FIG. 2 is a sectional view taken along line 2—2 of FIG. 1.

A float blade 10 of the present invention is illustrated in FIGS. 1–3. Float blade 10 includes a generally rectangular planar member 11 having a retaining tab 12A–12D mounted at each corner 14A–14D. Float blade 10 includes an upper surface 16A, and a lower surface 16B which engages concrete, cement or the like. Float blade 10 also includes end edges 15A–15B, leading edge 17 and trailing edge 19. As described below, retaining tabs 12A–12D cooperate to removably secure the float blade 10 to a desired other blade.

It is desirable that float blade 10 include beveled edges 15A—15B, 17, and 19 that are slanted toward the upper surface 16A of float blade 10 as illustrated best in FIGS. 2 and 3. During the floating operation, beveled edges 15A–15B, 17 and 19 enhance the float blade's ability to smooth the upper surface of the concrete by forcing stones and rocks down into the concrete. If desired, corners 14A–14D can be formed in configurations other than ninety degrees, e.g. approximately forty five degrees as illustrated in Figs. 1–4. Such "cut-off" corner configuration is advantageous in minimizing the occurrence of ridges in the concrete in the floating operation.

Figure 4:
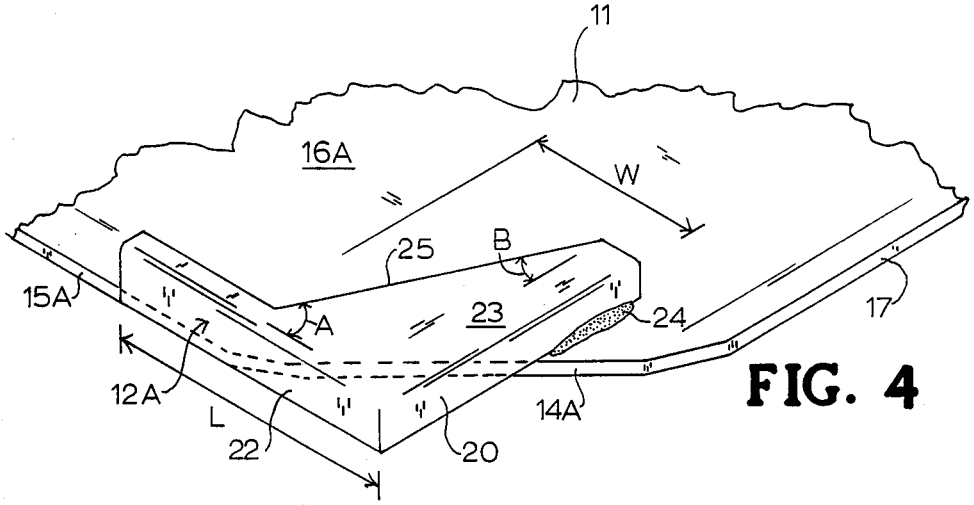
FIG. 4 is an enlarged perspective view illustrating the present retaining tab secured to the upper surface of the float blade of FIG. 1.
Figure 5:
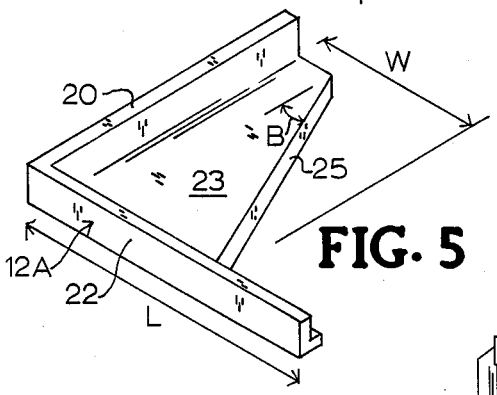
FIG. 5 is an enlarged perspective rear view of the retaining tab of FIG. 4 removed from the float blade.

As illustrated best in FIGS. 4 and 5, each retaining tab 12A–12D includes a side wall 20, an end wall 22 and a cover plate 23. Preferably, retaining tab 12A is mounted on the upper surface 16A of float blade 10 so that cover plate 23 is positioned at the corner 14A of float blade 10. End wall 22 is aligned with end edge 15A. Side wall 20 is parallel to leading edge 17 and trailing edge 19. The lower portion of side wall 20 is secured to the upper surface 16A of float blade 10 by any suitable means, e.g. weld 24. Cover plate 23 is provided between side wall 20 and end wall 22 and forms a cavity 26 (FIGS. 2 & 3) with the upper surface 16A of float blade 10 for receiving a blade as described below. The retaining tab side wall 20 and end wall 22 are thus generally perpendicular to one another, and the interior main edge 25 of the cover plate 23 is angularly oriented with respect to the side wall 20 and end wall 22, defining acute included angles A and B therewith.

The maximum width W of cover plate 23 is less than the length L of end wall 22 (FIGS. 4 & 5). This feature of length L being greater than width W is a significant advantage since finishing blades (described below) wear substantially in use, so that their widths (i.e., dimension in the direction parallel to arrows W and L in FIG. 4) become substantially reduced with time. The length of the end wall 22 thus provides the practical benefit that even when a finishing blade is worn down and of shortened width, end wall 22 still retains the float blade 10 in place on the finishing blade, and prevents the float bade 10 from disengaging from the trowel under the action of centrifugal force during operation.

Figure 6:
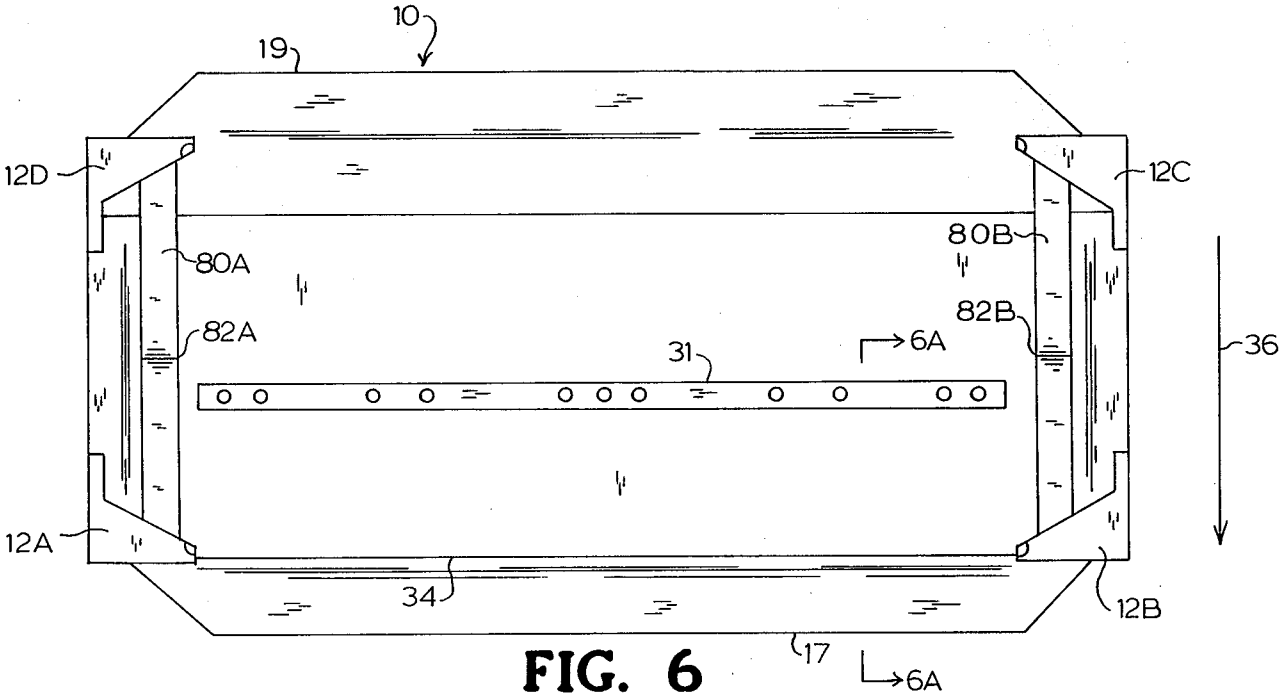
FIG. 6 is a top plan view of the float blade of FIG. 1 mounted on a trowel finishing blade.
Figure 6A:
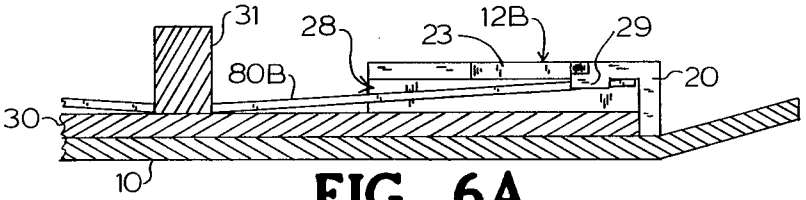
FIG. 6A is an enlarged sectional view taken along line 6A—6A of FIG. 6 illustrating a retaining clip securing the float blade to a finishing blade.

Side wall 20 and end wall 22 of the retaining tab are of sufficient height so that a gap 28 remains between a blade 30 received in cavity 26 and the lower surface of cover plate 23 (FIG. 6A). Gap 28 may for example be on the order of about ¼ inch in vertical dimension.

Figure 7:
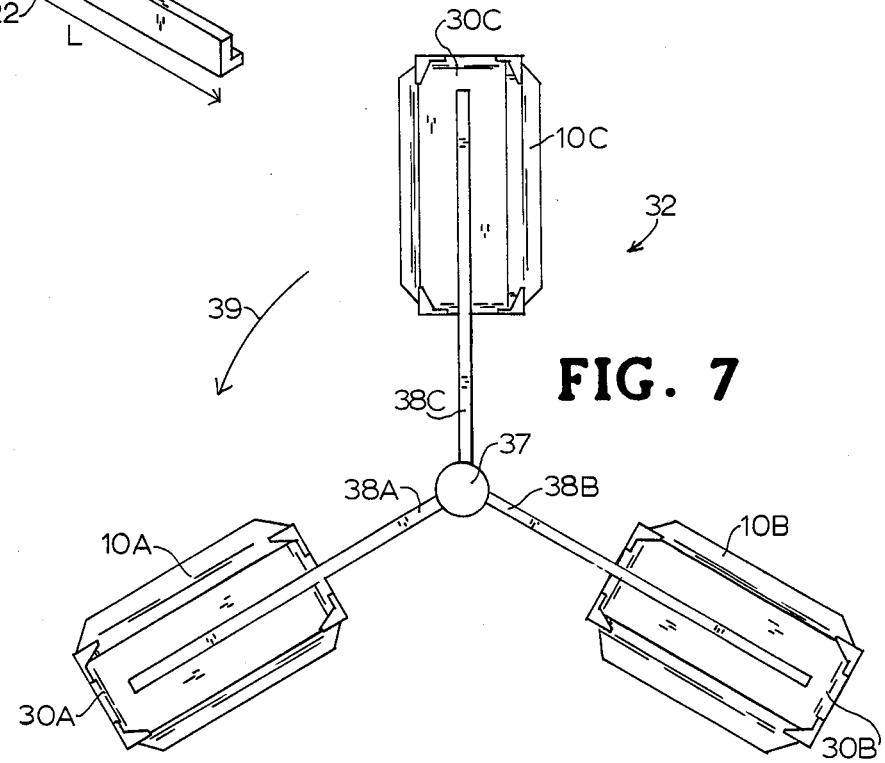
FIG. 7 is a top plan view of a trowel blade assembly mounting the float blades of FIG. 1.

For installation, float blade 10 is removably secured to blade 30 (FIG. 6) of a trowel blade assembly 32 (FIG. 7). As illustrated in FIG. 6, a leading edge 34 of blade 30 is received in the cavities 26 of retaining tabs 12A and 12B adjacent leading edge 17. Blade 30 includes a bracket 31 for mounting to blade assembly 32. As blade 30 moves in the direction of arrow 36, leading edge 34 is retained in cavities 26 by cover plates 23. As the floating operation occurs, beveled leading edge 17 and the gap 28 between blade 30 and cover plate 23 permit float blade 10 to shift and "float" over the surface of unfinished cement or concrete. As the leading edge 17 wears, float blade 10 can be quickly remounted on blade 30 so that trailing edge 19 becomes the leading edge, thereby extending the life of float blade 10.

The retaining tabs 12A–12D of the present invention are thus simple in construction and readily fabricated and employed. In contrast to various blade mounting means heretofore employed for mounting other blades on trowel finishing blades, the retaining tabs 12A–12D of the present invention are devoid of mechanical fasteners, e.g. clamps, brackets, mounting screws and the like. Accordingly, the mounting tabs 12A–12D of the invention achieve a substantial advance in the art as regards their simplicity and ease of use.

Figure 6B:
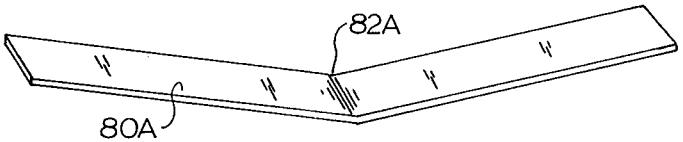
FIG. 6B is an enlarged perspective view of the retaining clip.

If desired, retaining clips 80A and 80B can be utilized with retaining tabs 12A–12D to further secure float blade 10 to blade 30. As illustrated best in FIG. 6B, each clip 80A and 80B is preferrable a longitudinal angled member having an apex 82A and 82B, respectively, near its mid-point. When viewed from the side, each clip 80A and 80B resembles a "V" having an acute angle. In use, clip 80A is inserted in the respective gaps 28 formed by tabs 12A and 12D. Clip 80B is inserted in the respective gaps formed by tabs 12B and 12C. Each clip 80A and 80B forms a spring-type fit in respective tabs 12A–12D, thereby biasing each apex 82A and 82B against blade 30.

Clips 80A and 80B are retained in respective gaps 28 by a retention flanges 29 illustrated in FIG. 6A. Flange 29 is provided along interior main edge 25 of cover plate 23 and protrudes below the lower surface of cover plate 23. In the event clip 80A or 80B shifts in gap 28, flange 29 engages and blocks the clip 80A or 80B, thereby preventing an unwanted exit of clip 80A or 80B from gap 28. To remove a clip 80A or 80B, a user presses downwardly on an outer portion of the clip 80A and 80B to clear flange 29.

Flange 29 can be formed in any suitable manner. In the embodiment illustrated in FIG. 6A, a die punch tool (not illustrated) can be used to form flange 29 along interior main edge 25.

As illustrated in FIG. 7, a typical blade assembly 32 includes three float blades 10A–10C removably mounted on respective finishing blades 30A–30C. A power shaft 37 includes three spokes 38A–38C. As the assembly 32 rotates in the direction of arrow 39, float blades 10A–10C are retained on blades 30A–30C.

Figure 11:
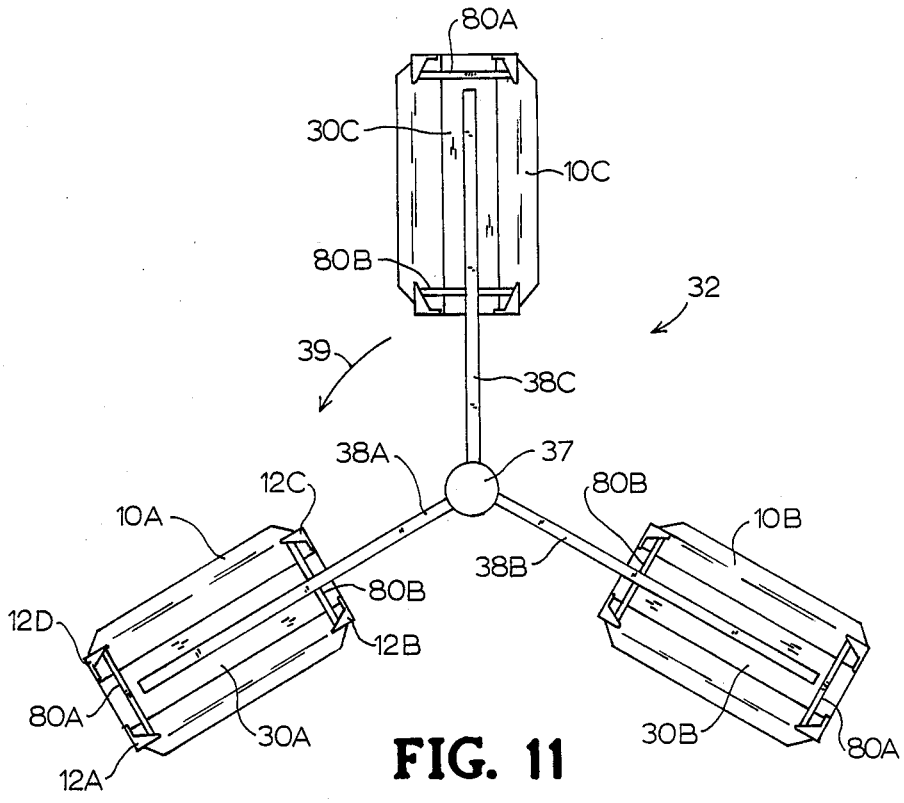
FIG. 11 is a top plan view of a trowel blade assembly illustrating float blades retained to worn finishing blades by the retaining clip of the present invention.

After repeated use, blades 30A–30C can wear so that each blade's width is less than the distance between tab pairs 12A, 12D and 12B, 12C. As illustrated in FIG. 11, each blade 30A–30C is worn and does not span the distance between tab pairs 12A, 12D and 12B, 12C. In such cases, clips 80A and 80B can be utilized to effectively secure float blades 10A–10B to respective blades 30A–30C of a trowel blade assembly 32.

Figure 8:
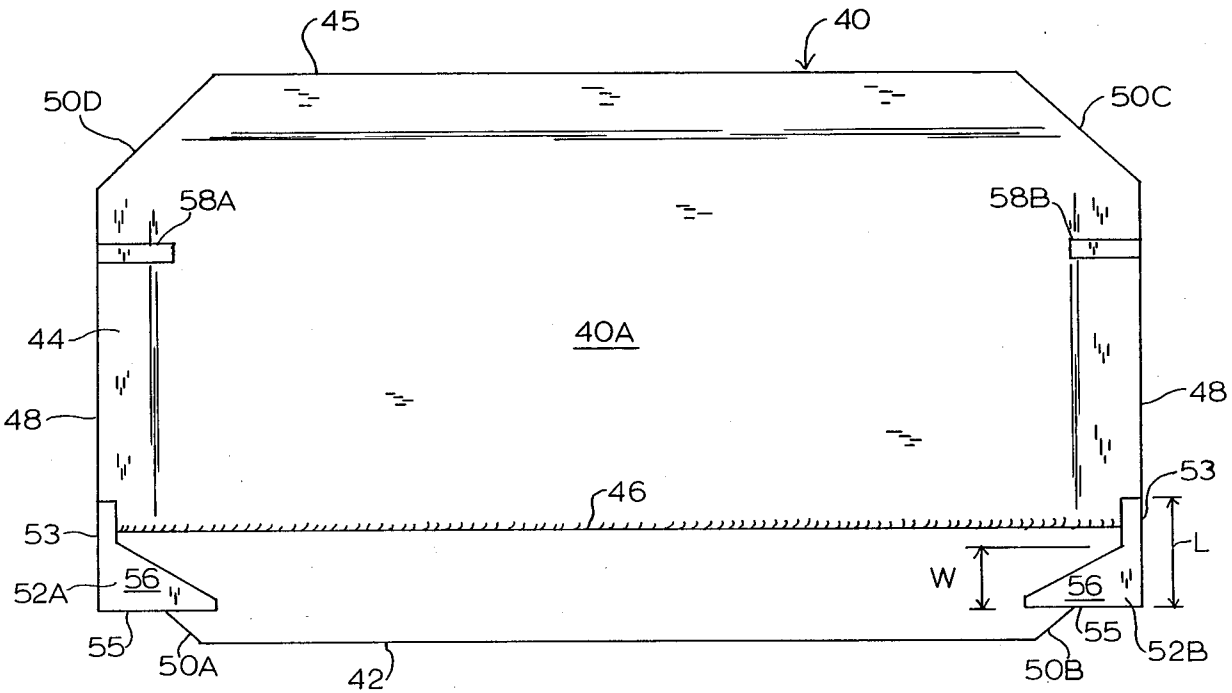
FIG. 8 is a top plan view of a combination blade employing the present mounting apparatus.
Figure 9:
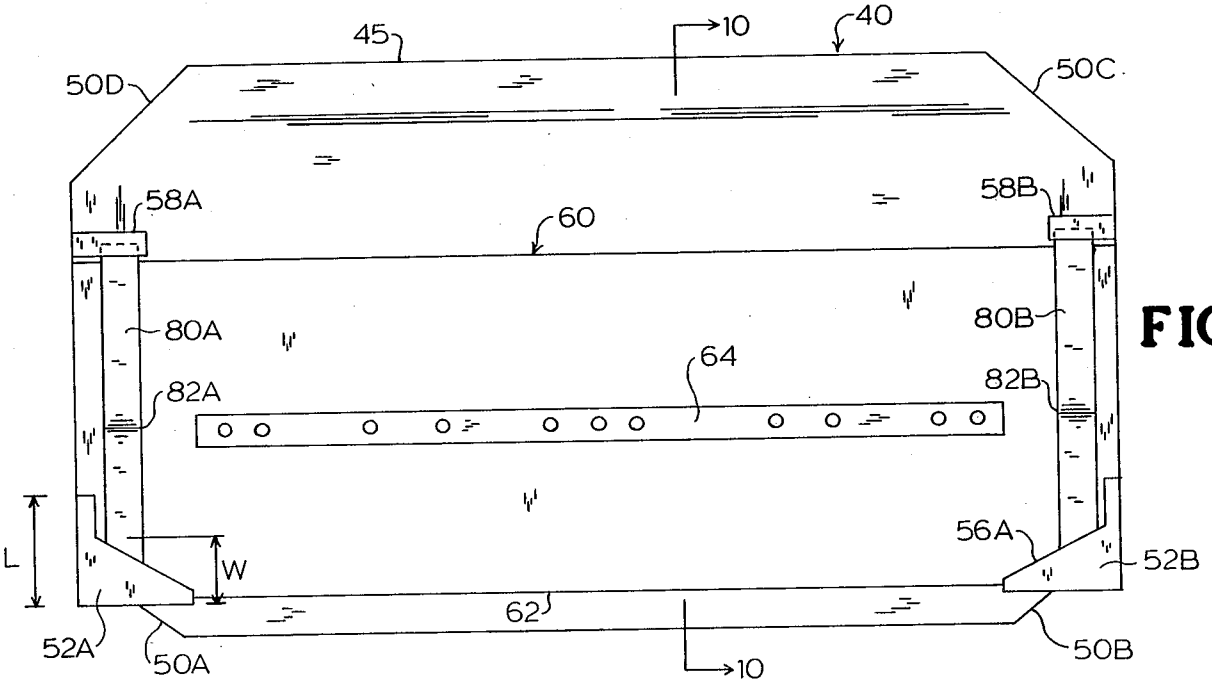
FIG. 9 is a top plan view of the combination blade of FIG. 9 mounted on a trowel finishing blade.
Figure 10:
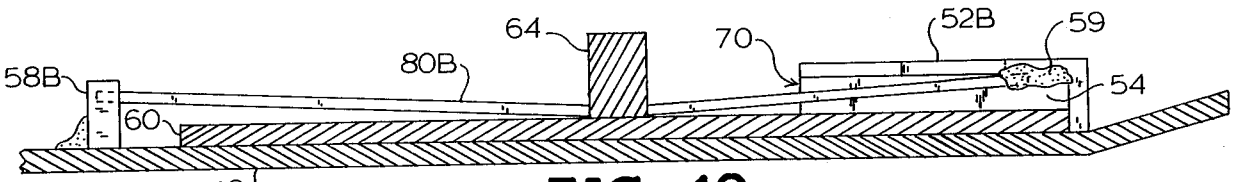
FIG. 10 is an enlarged sectional view taken along line 10—10 of FIG. 9 illustrating a retaining clip securing the combination blade to a finishing blade.

A combination blade 40 is illustrated in FIGS. 8–10. Combination blade 40 includes a leading edge member 42 secured to a body portion 44 by any suitable manner, e.g. weld 46. Body portion 44 includes a trailing edge 45 and end edges 48. It is desirable that leading edge member 42 be constructed from a durable, abrasion-resistant steel. For example, the leading edge member 42 may be formed of a hot rolled steel while the body portion 44 is spring steel, or both the leading edge member 42 and the body portion 44 may be formed of spring steel. Leading edge member 42 and body portion 44 form a generally rectangular planar member having corners 50A–50D. It is desirable that corners 50A–50D be angled as illustrated in FIGS. 8 and 9. Furthermore, it is desirable that edges of the leading edge member 42, and the body portion edges 45 and 48 be beveled toward the upper surface 40A of plate 40.

Retaining tabs 52A and 52B, identical to retaining tabs 12A–12D described above, are secured to corners 50A and 50B by any suitable means, e.g. welding. Tabs 52A and 52B include end walls 53, side walls 55 and cover plate 56. A cavity 54, identical to cavity 26, is formed between the upper surface 40A of combination blade 40 and cover plate 56 of retaining tab 52. Preferably, the maximum width W of cover plate 56 is less than the length L of tabs 52A and 52B.

A pair of stop elements 58A and 58B are provided on the upper surface 40A of combination blade 40 and cooperate with tabs 52 to mount a finishing blade 60 of a conventional blade assembly (not illustrated). Stop elements 58A and 58B are vertical members which are secured to the upper surface 40A by any conventional means, e.g. by welding. In other embodiments, a single stop element or a plurality of stop elements can be utilized.

For installation, a leading edge 62 of a blade 60 is received in cavities 54. Stops 58A and 58B form a backstop for retaining blade 60. Blade 60 can include a bracket 64 for mounting the blade assembly 32 on a trowel.

As illustrated in FIG. 10, the height of end walls 53 and side walls 5 is sufficient so that a gap 70 remains between cover plate 56 and blade 60 after blade 60 has been received in cavity 54. Gap 70 permits combination blade 40 to shift and "float" over the surface of unfinished cement or concretes.

It will be understood that retaining clips 80A and 80B can be utilized with combination blade 40 to further secure combination blade 40 to finishing blade 60. As illustrated in FIG. 10, each clip 80A and 80B is received in respective gaps 70 of tabs 52A and 52B. A slot (not illustrated) is provided in each stop element 58A and 58B to retain the opposite end of each clip 80A and 80B. In the alternative, other configurations, e.g. a flange, can be utilized to secured clips 80A and 80B to respective stop elements 58A and 58B. Each apex 82A and 82B is biased against finishing blade 60. Flange 59, illustrated as weld material, is provided at the interior main edge 56A of cover plate 56 to block an unwanted exit of each clip 80A and 80B from its respective gap 70. To remove a clip 80A or 80B, the clip 80A or 80B is depressed at its outer portion to clear flange 59. Once a clip 80A or 80B has been removed from gap 70, the opposite end of each clip 80A or 80B can be removed from the slot in respective stop elements 58A and 58B.

Although the present invention has been described with reference to preferred embodiments, persons skilled in the art will recognize that changes may be made in form and detail without departing from the spirit and scope of the invention.

What is claimed is:

1. An assembly for removably mounting a first blade on a second blade, comprising:

(a) tab means, secured to an upper surface of the first blade adjacent a leading edge, the tab means forming a cavity with the upper surface of the first blade for receiving a leading edge of the second blade and devoid of mechanical fastening means;

(b) retaining means secured to the upper surface of the first blade adjacent a trailing edge for retaining a trailing edge of the second blade; and (c) clip means associated with the tab means and retaining means for biasing the second blade against the first blade said clip means comprising at least one longitudinal angled member having an apex biased against the second blade and retained at one end by the tab means and retained at the opposite end by the retaining means.

2. The apparatus as specified in claim 1 wherein the tab means comprises a pair of retaining tabs, each retaining tab including a side wall, an end wall and a cover plate, wherein the maximum width of the cover plate is less than the length of the end wall.

3. The apparatus as specified in claim 2 wherein the side wall and the end wall are perpendicular to each other.

4. The apparatus as specified in claim 3 wherein the cover plate includes an interior edge angularly oriented with respect to the side wall and the end wall.

5. The apparatus as specified in claim 2 wherein the retaining means comprises a pair of retaining tabs, each retaining tab including a side wall, an end wall and a cover plate, wherein the maximum width of the cover plate is less than the length of the end wall.

6. The apparatus as specified in claim 5 wherein the side wall and the end wall are perpendicular to each other.

7. The apparatus as specified in claim 2 wherein the retaining means comprises at least one stop member projecting from the upper surface of the first blade.

8. The apparatus as specified in claim 1 wherein the height of the cavity is greater than the thickness of the second blade.

9. The apparatus as specified in claim 1 wherein the tab means and the retaining means includes flange means for retention of the clip means.

* * * * *